US008365558B2

(12) United States Patent
Garibaldi

(10) Patent No.: US 8,365,558 B2
(45) Date of Patent: Feb. 5, 2013

(54) SAFETY HANDCUFFS DESIGNED TO FACILITATE THE HANDCUFFING OF AN INDIVIDUAL

(76) Inventor: Jérome Garibaldi, Menton (FR)

( * ) Notice: Subject to any disclaimer, the term of this patent is extended or adjusted under 35 U.S.C. 154(b) by 56 days.

(21) Appl. No.: 12/703,089

(22) Filed: Feb. 9, 2010

(65) Prior Publication Data

US 2010/0206017 A1 Aug. 19, 2010

(30) Foreign Application Priority Data

Feb. 16, 2009 (FR) ..... 09 00680

(51) Int. Cl.
*E05B 75/00* (2006.01)

(52) U.S. Cl. ..... 70/16; 70/14; 70/15; 70/17; 70/18; 119/806; 119/756

(58) Field of Classification Search ..... 70/14–18; 119/806, 756
See application file for complete search history.

(56) References Cited

U.S. PATENT DOCUMENTS 636,439 A * 11/1899 Maltby ..... 70/17
686,626 A * 11/1901 Maltby ..... 70/16
691,941 A * 1/1902 Headson ..... 70/17
766,263 A * 8/1904 Judd ..... 70/16
772,468 A * 10/1904 Maltby ..... 70/16
1,116,329 A * 11/1914 Russell ..... 70/16
1,197,549 A * 9/1916 Russell ..... 70/17
2,516,878 A 8/1950 Howe et al.
4,314,466 A * 2/1982 Harris ..... 70/16
4,887,553 A * 12/1989 Trevelyan et al. ..... 119/800
5,482,271 A * 1/1996 McNutt ..... 119/808
5,555,751 A 9/1996 Strickland et al.
5,799,514 A 9/1998 Tobin, Jr. et al.

FOREIGN PATENT DOCUMENTS

FR 829 746 7/1938
GB 2 439 088 12/2007

OTHER PUBLICATIONS

French Search Report for Application No. FR 0900680, dated Sep. 28, 2009.
French Written Opinion for Application No. FR 0900680, dated Feb. 16, 2009.

* cited by examiner

*Primary Examiner* — Lloyd Gall
*Assistant Examiner* — Ifeolu Adeboyejo
(74) *Attorney, Agent, or Firm* — IM IP Law PLLC; C. Andrew Im

(57) ABSTRACT

Handcuffs made up of a half-bracelet (21), a second half-bracelet (11), at least one casing (1) with a mean of locking (22, 41, 5, 7) and unlocking (4, 5, 9). The second half-bracelet (11) being interdependent (or not) from the casing of the handcuffs. A main characteristic being that the first half-bracelet pivots around an axis (100) located within the casing. The handcuff has a mean of control (3, 6, 200, 24) the first half-bracelet can move around its axis in order to allow a frontal gripping of the hand (or leg) to be blocked.

18 Claims, 4 Drawing Sheets

SAFETY HANDCUFFS DESIGNED TO FACILITATE THE HANDCUFFING OF AN INDIVIDUAL

The present invention relates to the technical field of handcuffs made of one or two bracelets linked to each other and intended to be attached to one or two wrists of an individual. The described handcuffs are designed to facilitate the handcuffing of an individual.

BACKGROUND OF THE INVENTION

Usually handcuffs include a first half-bracelet rotating around a second half-bracelet, the first half-bracelet being equipped at its open end with a ratchet interlocking with the internal pawl. The pawl is located inside the handcuffs casing and is usually interdependent from the second half-bracelet. The locking teeth prevent the first half-bracelet from unlocking when the ratchet interlocks with the internal pawl. The handcuffs are thus locked around the wrist of an individual or locked around an object in order to be fixed to him. The length of the ratchet is designed so that the handcuffs perfectly adjust themselves to wrists of various sizes as well as to ankles. The casing includes means for locking and unlocking.

These kinds of handcuffs suffer from several disadvantages. First of all, two hands are needed to cuff a member to be restrained. One hand must hold the handcuffs casing and the second half-bracelet against the member to be restrained, while the other hand must adjust the first half-bracelet, pushing the ratchet in deeper or shallower. During this manipulation, the operator is at the risk of aggressive behavior by the person to be restrained. If the arrested person resists, classic handcuffs cannot be used. Also these handcuffs require that the member to be restrained is not held to the body or against any surface. In effect, the first half-bracelet needs room to close freely to the second.

Moreover, in order to remove the handcuffs, the operator has to hold them in one hand, open them with the key and then release the blocked member. All these manipulations make the use of handcuffs tedious and not well suited to situations sometimes requiring urgency and speed.

Therefore, it would be desirable to provide handcuffs without these disadvantages and equipped with a means of handcuffing with one hand.

SUMMARY OF THE INVENTION

According to one embodiment of the invention, handcuffs for gripping a member comprise a first half-bracelet, a second half-bracelet configured to close with the first half-bracelet around the member by pivoting around a first axis, a locking mechanism including a sensor assembly configured to block opening of the first half-bracelet and the second half-bracelet in response to pressure from the member, and an opening mechanism configured to open the first half-bracelet open relative to the second half-bracelet in the absence of the member applying pressure to the sensor.

According to an aspect of the invention, the first half-bracelet has a central part located around the first axis that includes a clasp having first teeth configured to engage with second teeth of an opening lever, the first and second teeth being maintained against each other by a pull-back spring.

According to another aspect of the invention, the opening lever is configured to release the teeth of the clasp while pivoting on a second axis against the action of the spring.

According to another aspect of the invention, the opening lever is configured to release the teeth of the clasp while pivoting on a second axis against the action of the spring.

According to another aspect of the invention, the opening lever pivots around the second axis against the action of the spring by the action of an opening component.

According to another aspect of the invention, the opening lever pivots around the second axis and against the spring in response to movement of a key.

According to another aspect of the invention, the handcuff further comprises a wheel at the end of the second half-bracelet configured to roll around the member to be blocked and so preventing the second half-bracelet to get caught on clothing or skin.

According to another aspect of the invention, the handcuff is coupled to another handcuff by means of rigid, flexible or articulated connection.

According to another aspect of the invention, the opening mechanism includes a clutch, a blocking notch and a spring configured to allow the handcuff to remain open yet prevent unintended closing.

According to another aspect of the invention, the locking mechanism includes a manual closing element in the form of a trigger, and the locking mechanism is configured to manually prevent unintended closing. The trigger may be configured to be actuated by an operator's finger.

According to another aspect of the invention, the locking mechanism includes a locking pawl and the first half-bracelet includes a notch into which the locking pawl is inserted against a return spring, whereby the first half-bracelet may be locked together in a closed position with the second half-bracelet.

According to another aspect of the invention, the opening mechanism includes a release lever configured to pivot around the first axis, and the opening mechanism includes a notch configured to receive by a pin of said locking pawl under action of said return spring to maintain the lock in an open position, whereby pressure from the member when disposed between the first and second half-bracelets displaces the release lever and turns the locking pawl around an axis to disengage the pin from said notch.

According to another aspect of the invention, the first half-bracelet includes an opening lever configured to be blocked by the opening mechanism while the first and second half-bracelets are locked in a closed position. In this embodiment, the first half-bracelet have teeth configured to be retained against teeth of the opening lever under force applied by a return spring.

According to another aspect of the invention, the opening lever is configured to disengage the teeth of the first half-bracelet by turning against the action of a spring by means of a key received in a keyhole.

BRIEF DESCRIPTION OF THE DRAWINGS

Goals, objects and characteristics of this invention will appear more clearly after reading the following description and referring to the following drawings.

DETAILED DESCRIPTION OF THE PREFERRED EMBODIMENTS

Figure 1:
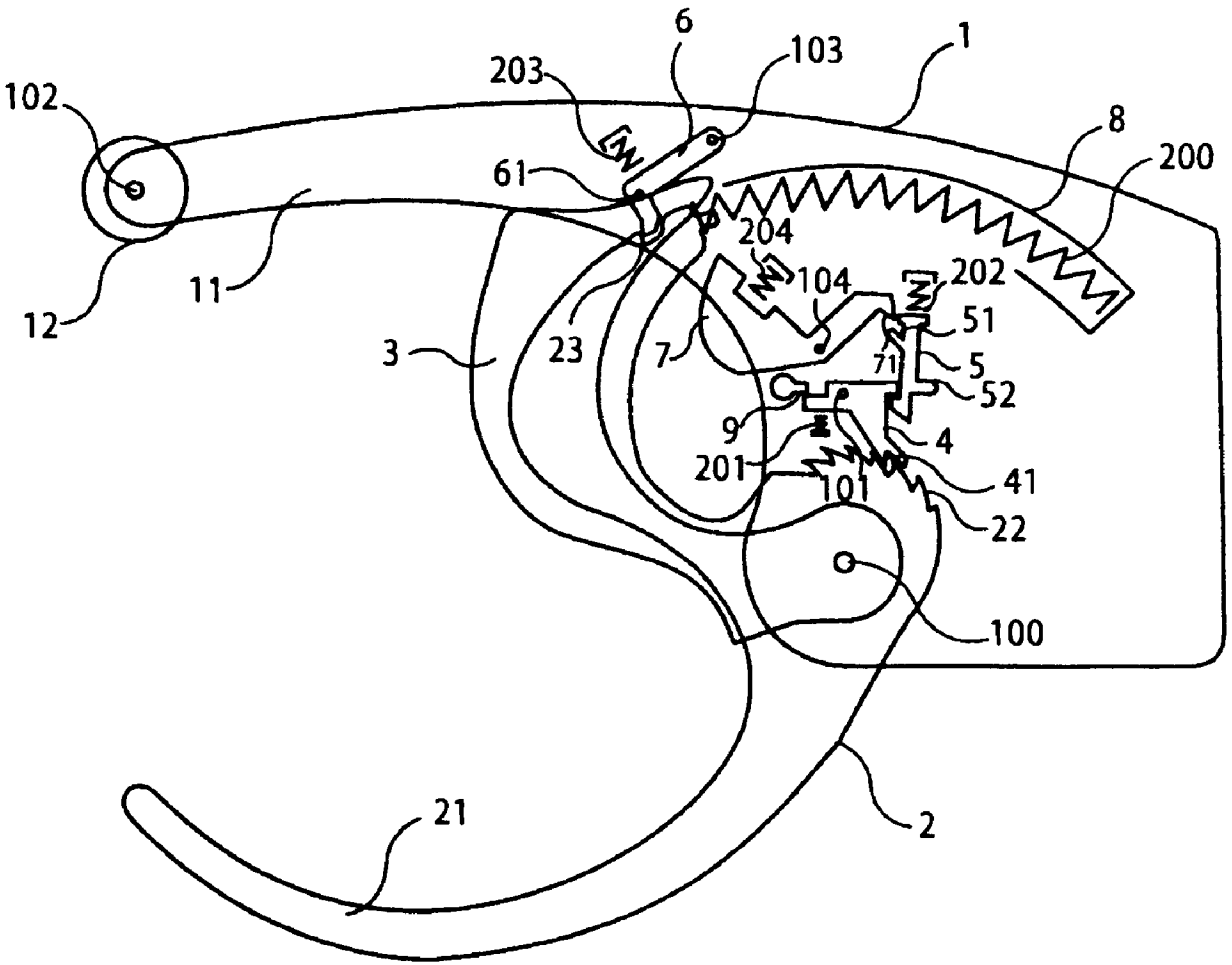
FIG. 1 is a view of a handcuff in an open position according to a first embodiment.

FIG. 1 illustrates a handcuff according to a first embodiment. The handcuff includes a casing 1.

One end of the handcuff's casing 1 extends to second half-bracelet 11. Note: the second half-bracelet 11 can be interdependent or not from the handcuff's casing 1.

In this embodiment, the body of the handcuff is preferably made of two separate, nearly identical components with a locking-unlocking mechanism disposed in-between. A moving clasp 2 is located between the handcuff's two body components 1. The clasp 2 is S-shaped, pivots around an axis 100 located in a central area, and is fixed to the casing of the handcuff. The curved interior of a lower part 21 of the clasp 2 forms a first half-bracelet.

The upper part of the clasp 2 slides into a holding housing 8 and is held within by a powerful pull-back spring 200. In its upper part, the clasp 2 is attached to a clutch 3 that rotates around the axis 100. The clutch is placed in such a way that it is superimposed on the curved outside of the upper part of the clasp 2. The clasp 2 has inclined teeth 22 at the axis 100, which interact with an opening lever 4. The opening lever 4 rotates around an axis 101 fixed to the carcass. The teeth of the opening lever 4 are maintained against the teeth 22 of the clasp 2 due to a spring 201, so that as long as two teeth are synchronized, the first half-bracelet 21 can only turn around the axis 100 in the direction that brings it to the second half-bracelet 11, therefore in the direction which closes the handcuff. In order to disengage the teeth 22 and 41 and thus allow the clasp to turn around the axis 100 in the direction away from the second half-bracelet 11, therefore opening the handcuff, the opening lever 4 must push against the pull-back spring 201.

The opening component 5 is laid out and adapted so that, when it is pushed against a pull-back spring 202, due to a manual control 52, it moves the lever 4, which rotates around its axis 101. This action disengages the teeth in opposition of the clasp 2 and the opening lever 4. The clasp 2, now no longer being blocked by the lever 4, is forced by the spring 200 into a circular motion around the axis 100 of the opening direction. And so the handcuff is ready to be used. The hand control 52 is part of the opening component and is located outside the handcuff casing 1 in order to be easily handled by the operator.

Open at its maximum, the ratchet 6 rotating around an axis 103 fixed to the handcuff casing penetrates into the appropriate notch 23 of the clasp 2. The ratchet 6 is kept in this position due to a pull-back spring 203. This interaction prevents any inopportune closing of the handcuff especially in the open position, when trying to place it between the member and a surface.

Once opened, the handcuff is ready for use. The operator holds the handcuff in one hand, directs it towards the member to be blocked so it passes between a wheel 12 and the end of the clasp 2. The wheel 12 turns freely around the axis 102 fixed at the end of second half-bracelet 11. The turning movement of the wheel 12 avoids the second half-bracelet from getting caught up in the skin, clothing or other obstruction.

A significant advantage of the just-described structure is that it allows a frontal gripping of a member to be restrained.

The action of pushing the member to be restrained towards the clutch 3 moves the clutch against pin 61 of the locking pawl 6. This pushing action makes the ratchet 6 turn clockwise around its axis 103, while being opposed to the pull-back spring 203 and releases the clasp 2. As long as the user continues to press on the member to be restrained, the clasp 2 also starts to turn while being opposed to the spring 200 so that first half-bracelet 21 is closing around the member to be blocked. Any attempt to reopen the handcuff is then prevented by teeth 22 of the clasp 2 synchronized with the reversed teeth of the opening lever 4. The operator gradually pushing the member closes the handcuff until the first half-bracelet is properly adjusted around it, tightened but without wounding it. The applied force from the member pushes onto a sensor 7, which picks up this action. This has the effect of turning it around the axis 104 fixed at the handcuff casing 1 and pushing against the pull-back spring 204 until the blocking pin 71 of the sensor is synchronized with the blocking pin 51 of the opening component 5.

In closed position, the first half-bracelet is on the second half-bracelet so that their ends cross. Preferably—the end of the second half-bracelet being made of two separate parts with a gap in between—when in closed position the first half-bracelet closes into this space.

Figure 2:
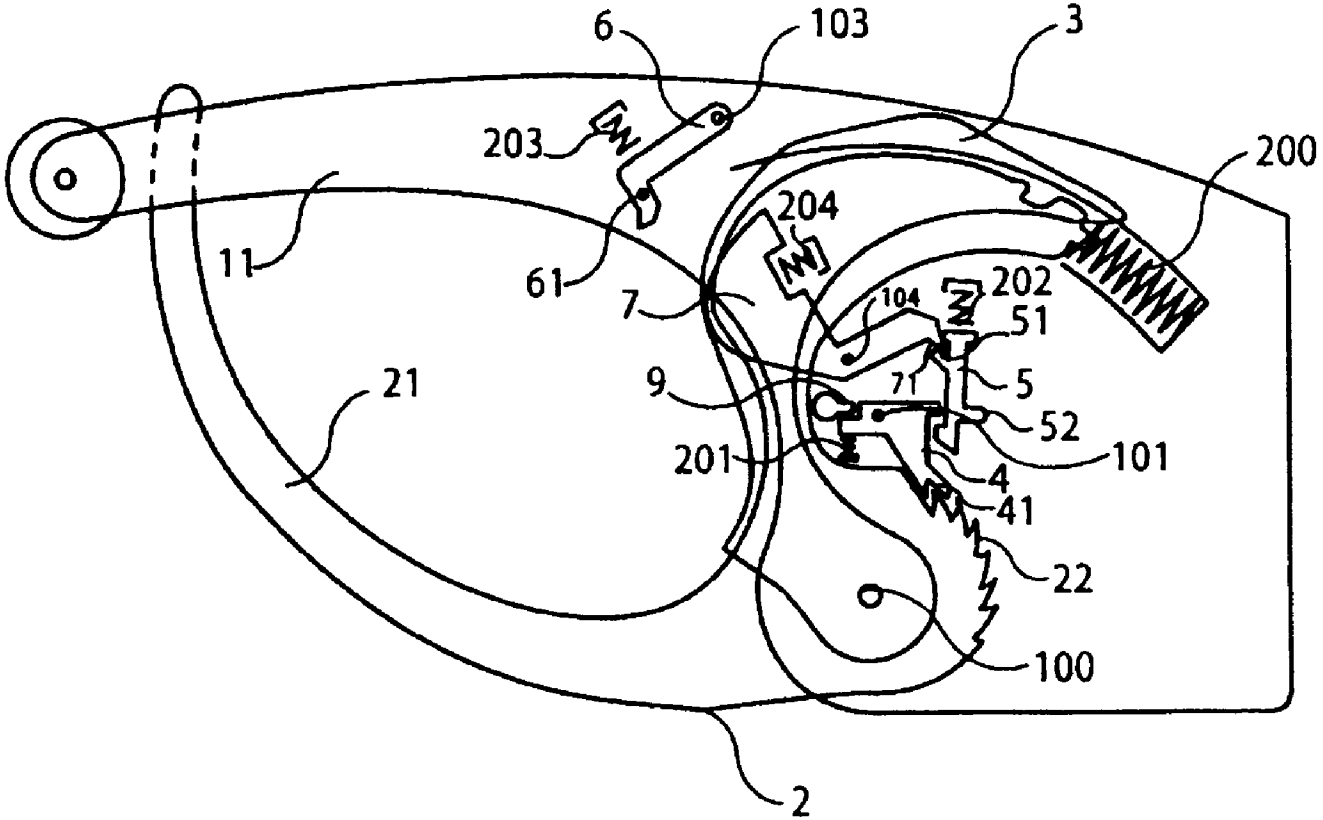
FIG. 2 is a view of the handcuff of FIG. 1 in a closed position.

FIG. 2 is a view of the handcuff in closed position, in which the handcuff would be closed around a member (not shown). In this position, the handcuff cannot be opened by pushing on component 52, such as when opening the handcuff when no member is present. To open the handcuff in this position, the operator must use a key. Specifically, the operator introduces the key into a lock 9, and, in this example, rotates the key one quarter turn clockwise. Turning the key pushes the opening lever 4 opposed to pull-back spring 201. This action disengages the opposing teeth of the clasp 2 and the opening lever 4. The clasp 2 no longer being blocked by the opening lever 4, is forced into a circular displacement around axis 100 by the spring 200, in the direction of opening of the handcuff. The member is therefore free.

This embodiment can be implemented in other ways. In a second embodiment, neither a clutch 3 nor a pull-back spring 200 is utilized. In this alternative, a closing command activated by the operator's forefinger (as depicted FIG. 3) is necessary to prevent the inopportune closing of the handcuff. Note that as an alternative to this embodiment, the handcuff only includes the opening lever 4 with its teeth 41 and its spring 201, as well as the lock 9.

Figure 4:
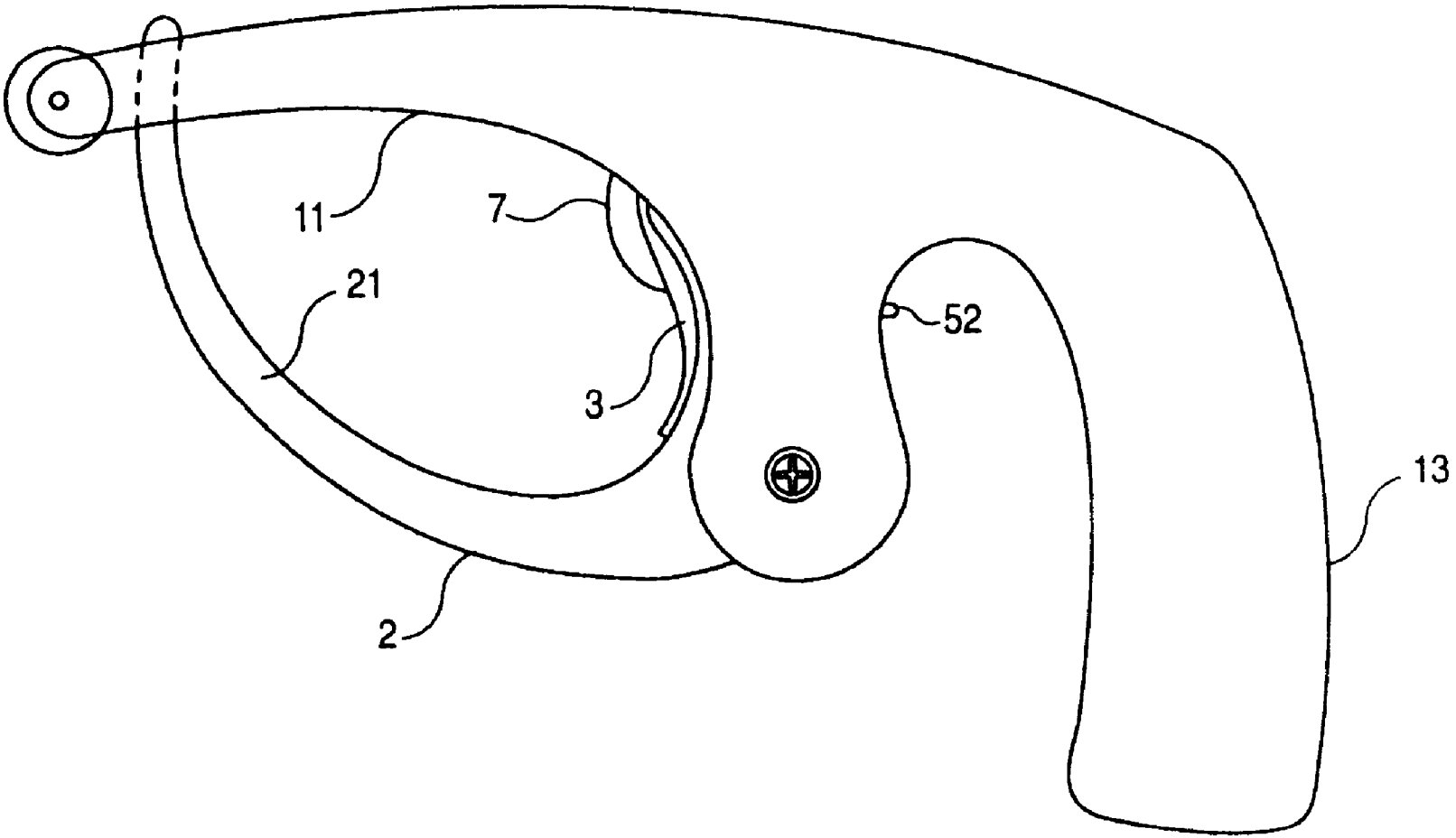
FIG. 4 is a view of the handcuff in closed position according to a second embodiment.

In another embodiment, the handcuff's casing can be extended at its other end by a handle 13 as shown in FIG. 4. Otherwise it is the same as the previous one. In FIG. 4, the handcuff is in its closed and unused position. The two crossed half-bracelets 11 and 21 form the bracelet of the handcuff. One can distinguish through the opening between the two, the clutch 3 retracted in the handcuff's casing and the sensor 7, which is not itself in the retracted position since there is no member enclosed in the handcuff. The grip 13 can be extended with a handle in order to block at a distance the member of an individual or even an animal leg, in the case of a potential danger.

Figure 3:
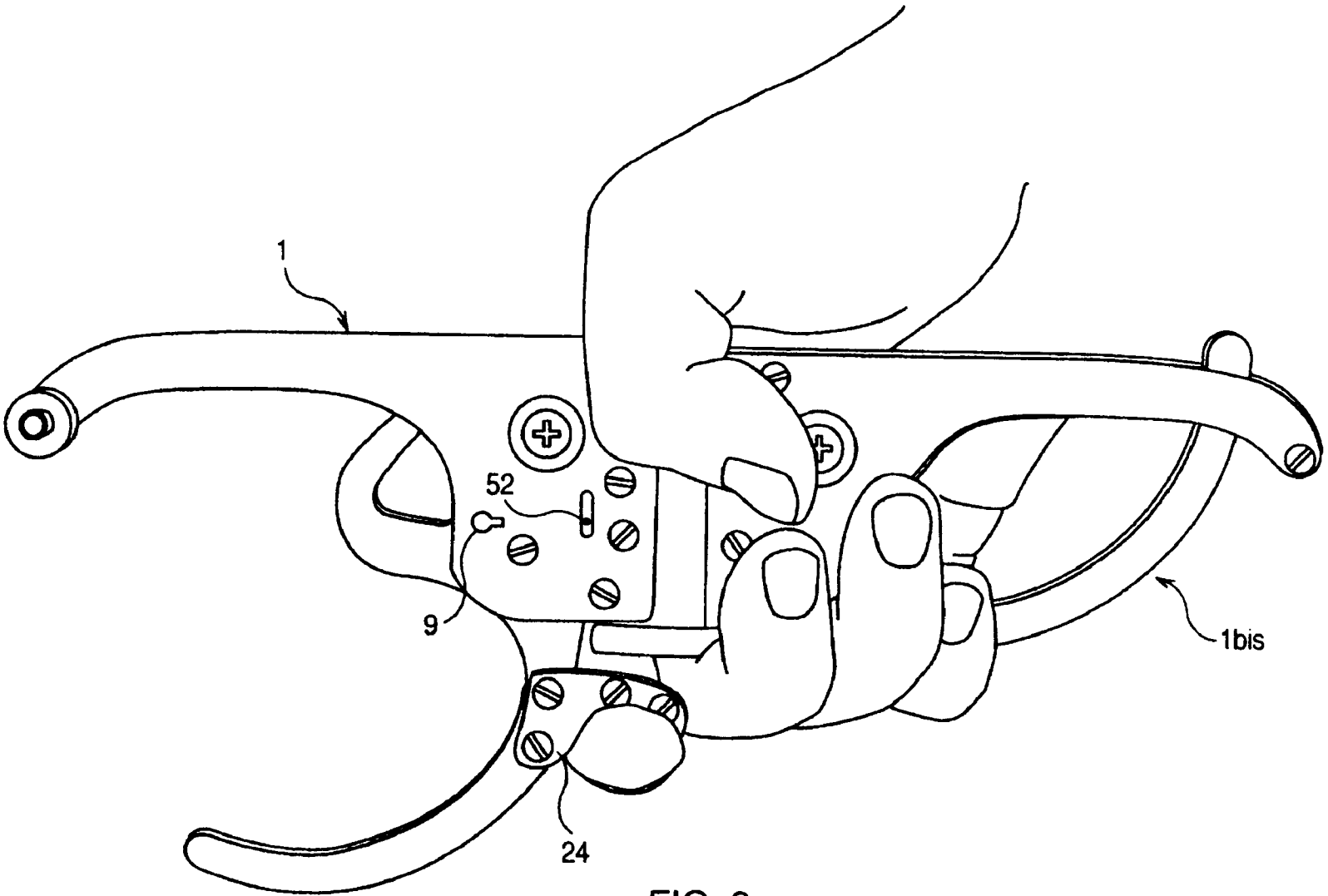
FIG. 3 is a view of a handcuff coupled with a second handcuff.

The body of the handcuff 1 can be extended to form a second in order to be able to block two members of a person or to hang the handcuff to a fixed object. The two handcuffs can be coupled together by means of rigid or articulated connection such as a pivoting connection around an axis, a chain, etc. FIG. 3 represents an example of a rigid model connected together. The second handcuff coupled with the first one can be identical or of another type such as a standard handcuff.

Handcuffs according to the invention can be made from various appropriate materials, including, for example, metal alloy, aluminum alloy, plastic or synthetic material.

A principal advantage of handcuffs according to the above-described embodiments is that they can be used even if the member to be blocked is against the body or another surface. Moreover, handcuffing an individual does not require the user to use his second hand to close the first half-bracelet around the member to be blocked.

Although the invention is described in its principal application of blocking the member of an individual, one could consider its usage in any other application but within the framework of this invention.

What is claimed is:

1. A handcuff for gripping a member comprising :

a first half-bracelet pivotable about a first axis, a second half-bracelet configured to close with the first half-bracelet around the member, a locking mechanism including a sensor configured to block opening of the first half-bracelet and the second half-bracelet in response to application of pressure from the member against the sensor after closure of the first and second half-bracelets, a wheel turning freely around a third axis fixed at an end of the second half-bracelet such that turning movement of the wheel prevents the second half-bracelet from getting caught on clothing or skin, and an opening mechanism configured to open the first half-bracelet relative to the second half-bracelet in absence of the member applying pressure to the sensor, wherein the sensor is configured to disable a manual control and to block opening of the first and second half-bracelets only when the member is between the first and second half-bracelets, so that the handcuff can be opened with the manual control and without a key when there is no member between the first and second half-bracelets.

2. A handcuff according to claim 1, wherein the first half-bracelet has a central part located around the first axis that includes a clasp having first teeth configured to engage with second teeth of an opening lever, the first and second teeth being maintained against each other by a pull-back spring.

3. A handcuff according to claim 2, wherein the opening lever is configured to release the first teeth of the clasp from the second teeth of the opening lever by pivoting on a second axis against an action of the pull-back spring.

4. A handcuff according to claim 3, wherein the opening lever is configured to pivot around the second axis against the action of the pull-back spring by action of an opening component.

5. A handcuff according to claim 3, wherein the opening lever is configured to pivot around the second axis against the pull-back spring in response to movement of the key.

6. A handcuff according to claim 1, wherein said handcuff is configured to be coupled to another handcuff by one of a rigid connection, a flexible connection, and an articulated connection.

7. A handcuff according to claim 1, wherein said opening mechanism includes a locking pawl, a blocking notch in the first half-bracelet, and a spring, wherein the opening mechanism is configured to allow the handcuff to remain open and to prevent unintended closing by application of spring force by the spring against the locking pawl such that the locking pawl is engaged with the blocking notch.

8. A handcuff according to claim 1, wherein said locking mechanism includes a manual closing element in a form of a trigger, said locking mechanism being configured to manually prevent unintended closing.

9. A handcuff according to claim 8, wherein said trigger is configured to be actuated by an operator's finger.

10. A handcuff according to claim 1, wherein said opening mechanism includes a locking pawl configured to pivot around a second axis, a return spring, and a notch, wherein said locking pawl comprises a pin, wherein the notch is configured to receive the pin of said locking pawl under action of said return spring to maintain the handcuff in an open position such that pressure from the member when disposed between the first and second half-bracelets displaces said locking pawl by turning said locking pawl around the second axis to disengage said pin from said notch.

11. A handcuff according to claim 1, wherein the first half-bracelet includes a clasp having first teeth, wherein the handcuff further comprises an opening lever having second teeth, wherein, in a closed position, the second teeth of the opening lever are configured to be retained against the first teeth of the clasp under force applied by a return spring, and wherein the opening lever is configured to be blocked from opening the first and second half-bracelets by the sensor after the closure of the first and second half-bracelets with the member therebetween.

12. A handcuff according to claim 1, wherein the first half-bracelet includes a clasp having first teeth, wherein the handcuff further comprises an opening lever having second teeth, wherein, in a closed position, the second teeth of the opening lever are configured to be retained against the first teeth of the first half-bracelet under force applied by a return spring, wherein the second teeth of said opening lever are configured to disengage the first teeth of the clasp by turning against the action of the return spring using the key received in a keyhole.

13. A handcuff according to claim 1, further comprising a clutch configured to actuate the closure of the first half-bracelet by application of pressure from the member against the clutch.

14. A handcuff for gripping a member comprising:

a first half-bracelet pivotable about a first axis, a second half-bracelet configured to close with the first half-bracelet around the member, a clutch configured to actuate closure of the first half-bracelet by application of pressure from the member against the clutch, a locking mechanism including a sensor configured to block opening of the first half-bracelet and the second half-bracelet in response to application of pressure from the member against the sensor, a wheel turning freely around a third axis fixed at an end of the second half-bracelet such that turning movement of the wheel prevents the second half-bracelet from getting caught on clothing or skin, and an opening mechanism configured to open the first half-bracelet relative to the second half-bracelet in absence of the member applying pressure to the sensor, wherein the sensor is configured to disable a manual control and to block opening of the first and second half-bracelets only when the member is between the first and second half-bracelets, so that the handcuff can be opened with the manual control and without a key when there is no member between the first and second half-bracelets.

15. A handcuff according to claim 14, wherein the first half-bracelet has a central part located around the first axis that includes a clasp having first teeth configured to engage with second teeth of an opening lever, the first and second teeth being maintained against each other by a pull-back spring.

16. A handcuff according to claim 14, wherein said locking mechanism includes a manual closing clement in a form of a trigger, said locking mechanism being configured to manually prevent unintended closing.

17. A handcuff according to claim 14, wherein said opening mechanism includes a locking pawl configured to pivot around a second axis, a return spring, and a notch, wherein said locking pawl comprises a pin, wherein the notch is configured to receive the pin of said locking pawl under action of said return spring to maintain the handcuff in an open position such that pressure from the member when disposed between the first and second half-bracelets displaces said locking pawl by turning said locking pawl around the second axis to disengage said pin from said notch.

18. A handcuff according to claim 14, wherein the first half-bracelet includes a clasp having first teeth, wherein the handcuff further comprises an opening lever having second teeth, wherein, in a closed position, the second teeth of the opening lever are configured to be retained against the first teeth of the clasp under force applied by a return spring, and wherein the opening lever is configured to be blocked from opening the first and second half-bracelets by the sensor after the closure of the first and second half-bracelets with the member therebetween.

* * * * *